United States Patent [19]

Krachten

[11] Patent Number: 5,027,625

[45] Date of Patent: Jul. 2, 1991

[54] LOCK WITH CATCH, SAFETY BOLT AND CATCH-LOCKING SLIDE

[76] Inventor: Theodor Krachten, Horstmarer Landweg 101, 4400 Muenster, Fed. Rep. of Germany

[21] Appl. No.: 354,438

[22] PCT Filed: Sep. 1, 1988

[86] PCT No.: PCT/EP88/00793

§ 371 Date: Jun. 6, 1989

§ 102(e) Date: Jun. 6, 1989

[87] PCT Pub. No.: WO89/02020

PCT Pub. Date: Mar. 9, 1989

[30] Foreign Application Priority Data

Sep. 4, 1987 [DE] Fed. Rep. of Germany ... 8712011[U]

[51] Int. Cl.[5] ..... E05B 59/00

[52] U.S. Cl. ..... 70/107; 70/110

[58] Field of Search ..... 70/92, 107, 110, 111; 292/34, 165, 336.5

[56] References Cited

U.S. PATENT DOCUMENTS

| | | | |
|---|---|---|---|
| 1,290,439 | 1/1919 | Weller | 70/107 |
| 1,478,322 | 12/1923 | Dalianis | 70/107 |
| 1,678,994 | 7/1928 | Mason | 70/107 |
| 1,855,608 | 4/1932 | Lyons et al. | 70/107 |
| 1,896,622 | 2/1933 | Hines | 70/107 |
| 2,303,624 | 12/1942 | Edwards et al. | 70/110 |
| 3,242,706 | 3/1966 | Check | 70/110 |
| 3,672,714 | 6/1972 | Schultz | 70/107 X |
| 3,783,658 | 1/1974 | Wada | 70/110 |
| 4,583,382 | 4/1986 | Hull | 70/107 |

*Primary Examiner*—Gary L. Smith
*Assistant Examiner*—Suzanne L. Dino
*Attorney, Agent, or Firm*—Felfe & Lynch

[57] ABSTRACT

A lock having a lock cylinder 22, a pusher nut 8, a catch 5 and a safety bolt 4, which can be actuated by the lock cylinder 22. The catch 5 is also retractable by means of the pusher nut. A catch locking slide 35 is displaceable from a release position to a locked position by pressure on the catch. A lever system 39, 40, 41 connects the locking slide 35 with the safety bolt 4 and has a dogging portion which embraces the locking slide 35. The dogging portion is actuated into a dogging position solely by pushing in and moving out of the catch 5, without operating the lock cylinder or a pusher spindle.

12 Claims, 6 Drawing Sheets

LOCK WITH CATCH, SAFETY BOLT AND CATCH-LOCKING SLIDE

The invention relates to a lock with a catch and bolt, which can be activated from a lock cylinder and the catch of which can be retracted by a pusher nut, as well as with a locking slide, in the locked position of which the catch is stopped from being pushed in. In a release position, in which the locking slide can be adjusted with the help of the pusher nut or the lock cylinder, the locking slide releases the catch, the locking slide being changed over from the release position to the locked position by the exertion of pressure on the catch.

Such a lock is disclosed in the older application of the Applicant (German Offenlegungsschrift No. 3,632,729), which was filed before the priority date of the present application but published later. Admittedly, the release position in the older lock is made possible with the help of the lock cylinder, but the safety bolt is not fixed. Moreover, the known lock made no provisions for a so-called panic function.

It is an object of the present invention to improve the older lock, so that, when pressure is exerted on the catch, not only is the catch arrested via the slope of the catch, but the bolt is also fixed.

This objective is accomplished by a lock, in which the locking slide is connected via a lever system with the safety bolt in such a fashion that, when the locking slide is shifted from the release position into the locked position as pressure is exerted on the catch, the safety bolt is shifted out of the lock.

For those skilled in the art, there are various possibilities of realizing such a lever system and developing an effective connection between the locking slide and the bolt. There is also the possibility of extending the bolt in different length. Since the locking slide is an essential part of the locking mechanism of the catch of the lock, it is also meaningful to design the lever system so that, as the locking slide moves, the lever system also presses the bolt into the closing position.

Preferably, the locking slide and the lever system are acted upon by a spring, which forces the locking slide into the locking position.

Further characteristics of the dependent claims arise out of the description of an example of the operation. The example of the operation is explained by means of the drawing, which comprises several Figures.

Figure 1:
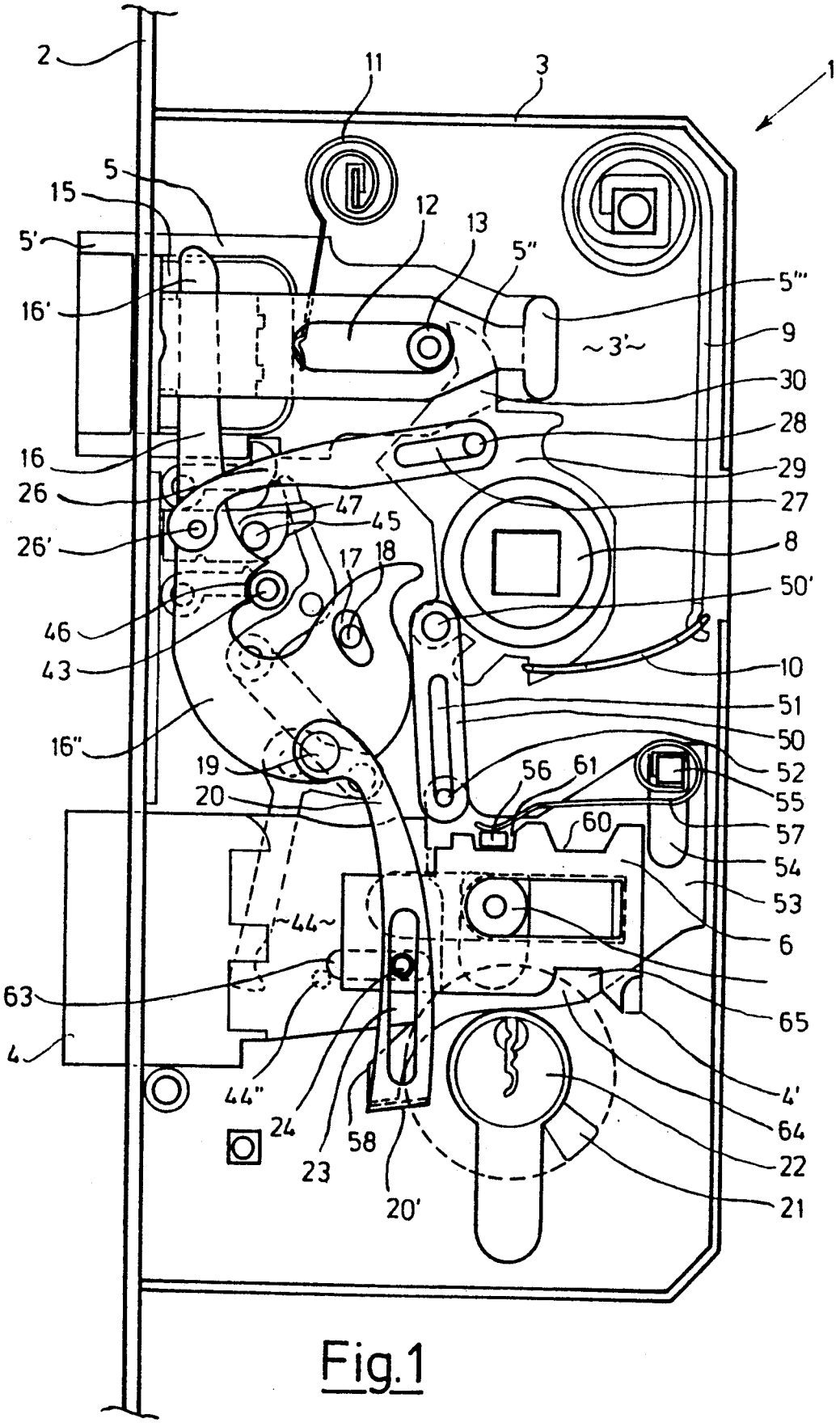
FIG. 1 shows a plan view of the interior of the lock, the upper plane of the active elements being emphasized.
Figure 2:
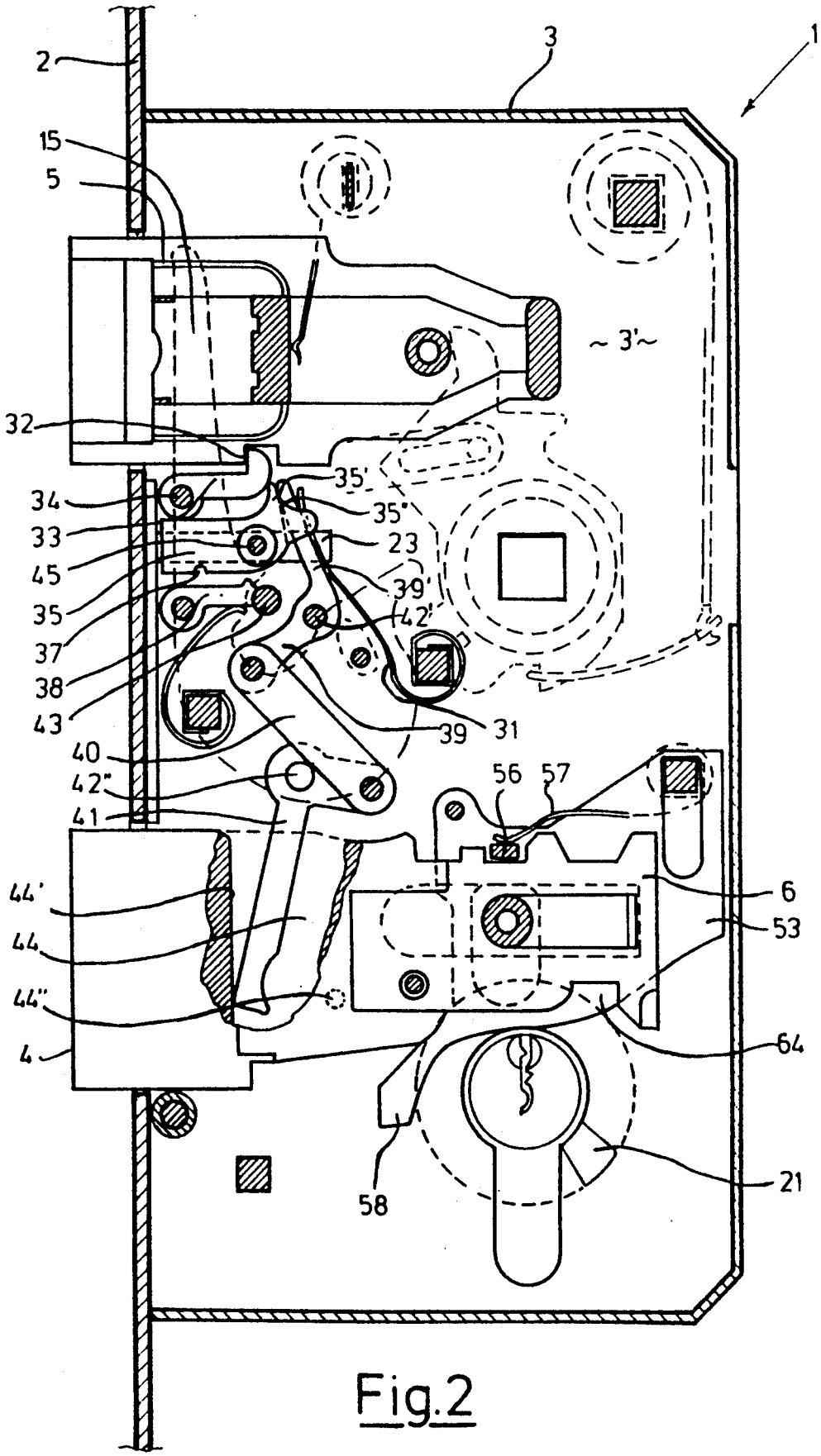
FIG. 2 shows a view similar to that of FIG. 1, in which, however, a plane below the active elements is emphasized.
Figure 3:
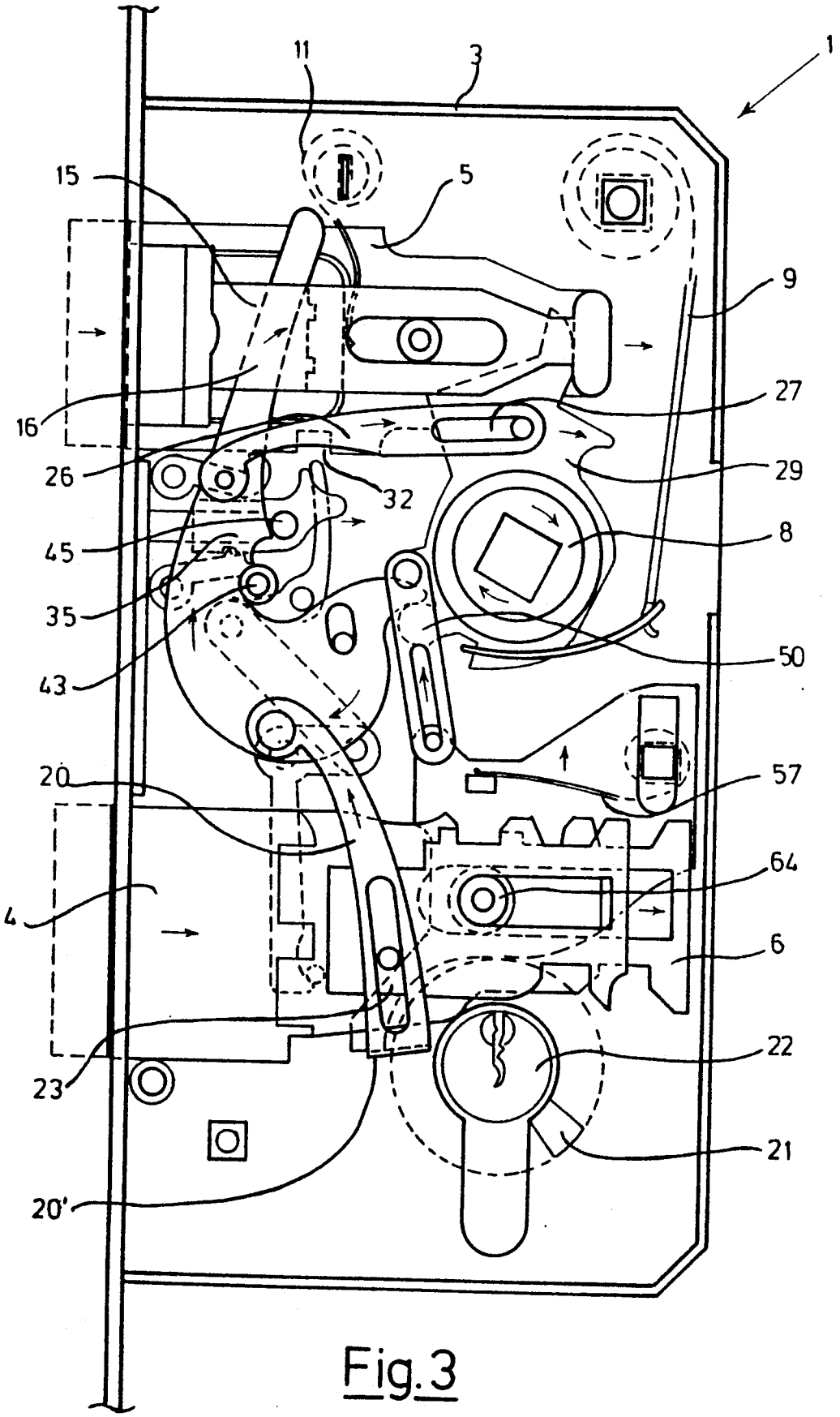
FIG. 3 shows the lock of FIG. 1 with the catch pushed in and the pusher nut rotated (first plane).
Figure 4:
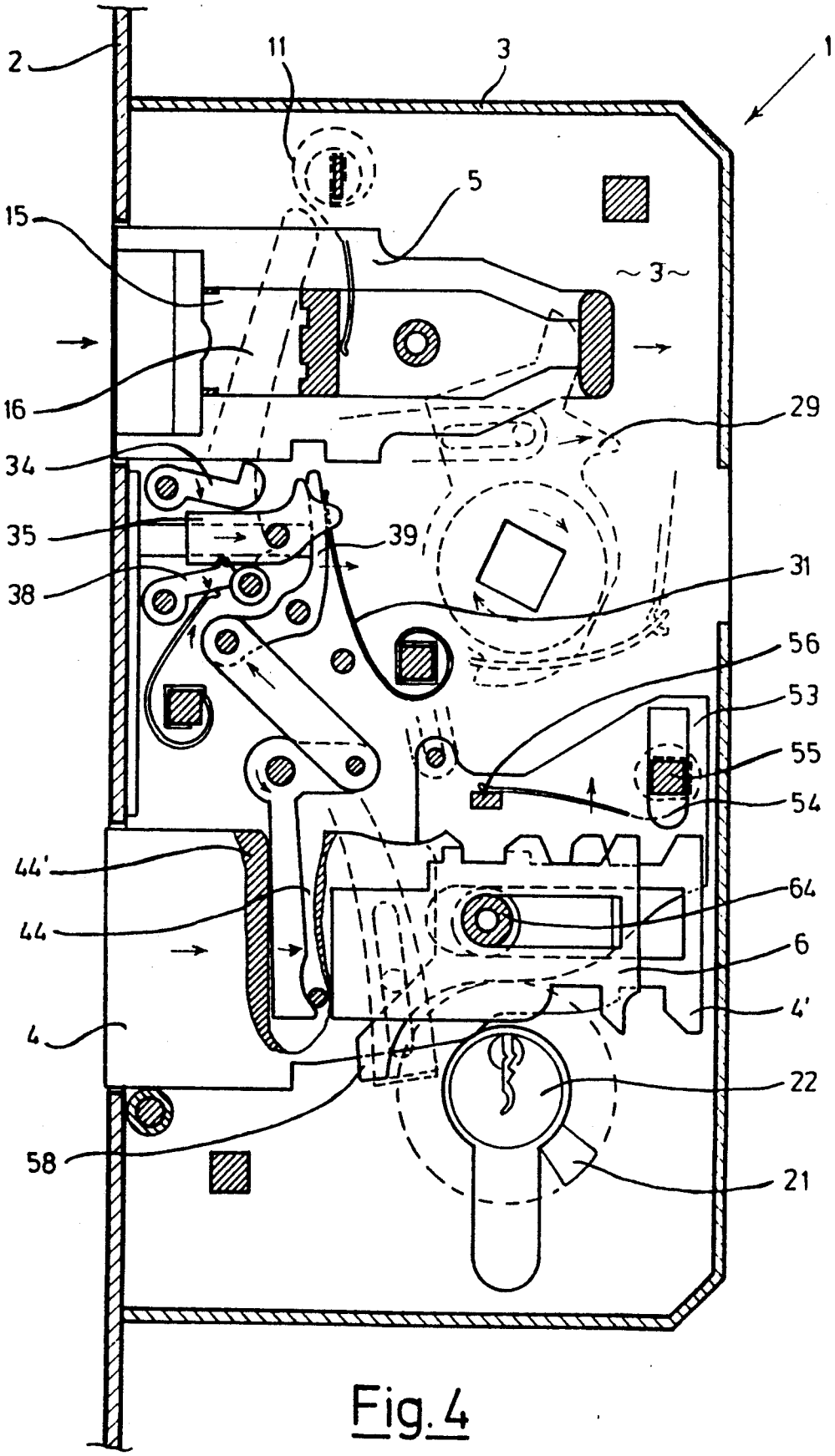
FIG. 4 shows the arrangement of FIG. 3 in a second lower-lying plane.
Figure 5:
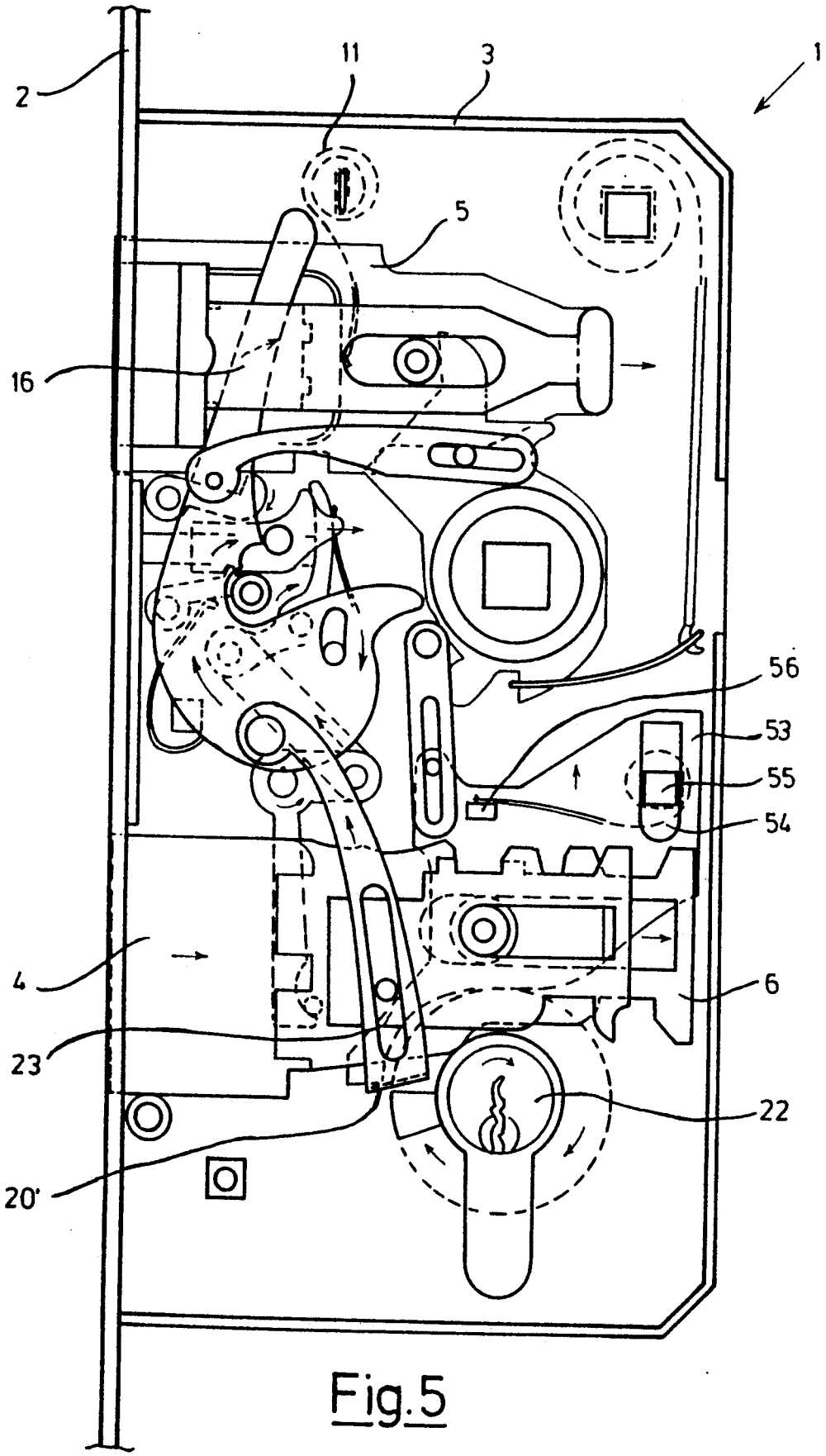
FIG. 5 shows the lock as the lock cylinder is activated.
Figure 6:
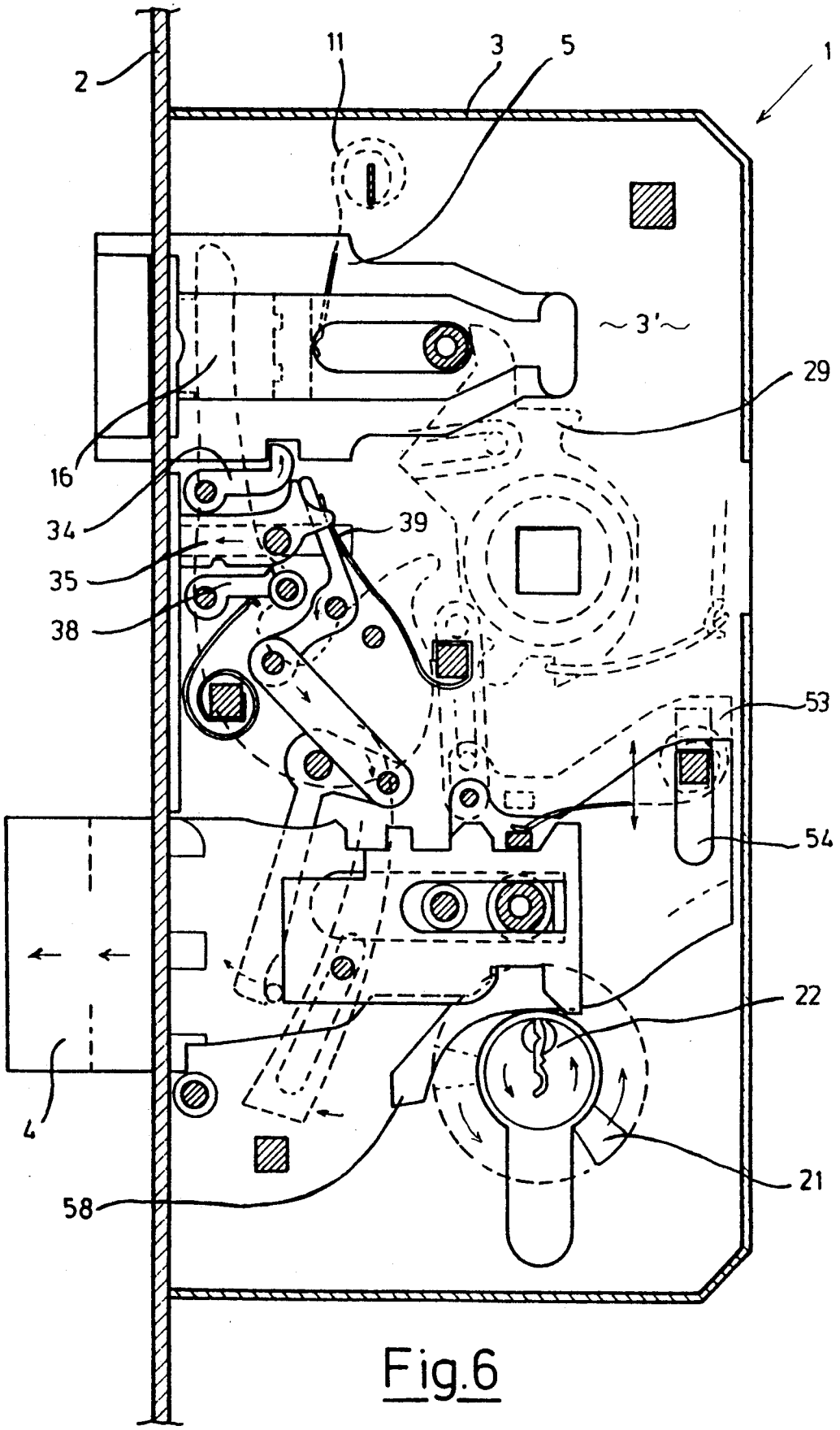
FIG. 6 shows the lock being closed by the lock cylinder.

The lock 1 of FIGS. 1 and 2 has a cuff 2, a lock case 3 with lock bottom 3', a bolt 4, a catch 5, a tumbler 6, which is acted upon by a tumbler spring 57 perpendicularly to the direction of motion of the bolt 4. The tumbler 6 at the top, the bolt 4 and the lock bolt tumbler 53 form three parts that slide one on top of the other.

Moreover, a pusher nut 8 is present, which is acted upon by a nut spring 9 via a transition piece 10. The pusher nut 8 runs out into an arm 29, which engages the catch tail 5'' with a projection 30, the catch 5 having a catch head 5' and a catch tail 5''. The catch 5 is acted upon by a catch spring 11 in the direction from the cuff 2. The catch tail 5'' is provided with an elongated hold 12, through which a guide bolt 13 passes. The catch 5 furthermore has a recess 15, which is shaped like a tunnel and through which the catch-side end 16' of an exchange lever 16 reaches.

The exchange lever 16 has approximately a J shape, is provided with a short hold guide 17 and hinged there with clearance on a pin 18. At its lower thickened end 16'' over a joint 19, the exchange lever 16 carries a cam 20. The closing beard 21 of a closing cylinder 22 bumps against the lower stop end 20' of the cam 20. Moreover, the cam 20 has an elongated hole guide 23, in which a bolt 24 slides, which is fastened to the tumbler 6.

Futhermore, in the middle region of the exchange lever 16, a pull bracket 26 is hinged at 26'. At its end remote from the joint, the pull bracket 26 has an elongated hole guide 27, which is engaged by a stay bolt 28, which in turn is connected with the arm 29 of the pusher nut 8.

FIG. 2 shows the plane of the lock 1 that lies below the exchange lever 16. The underside of the catch 5 is provided with a recess 32. In the state shown, a safety catch 33 engages this recess 32. This safety catch 33 is supported at 34 and falls out of its locked position under the action of gravity when it is not held. Below the safety catch 33, a locking slide 35 is installed. It is movable to a limited extent in the horizontal direction in a longitudinal hole guide 23, which is let into the bottom 3' of the lock.

At its front side, the locking slide 35 has a run-off piece 35', which in the in an extreme left position of FIG. 2 prevents the safety catch 33 falling down. The locking slide 35 moreover has on the side opposite the run-off piece 35' a stop face 35'', which presses against the upper end of a toggle lever 39. The locking slide 35 itself also has a locking device, namely a recess 37, which acts together with a spring-loaded catch 38.

The toggle lever 39, together with a fishplate lever 40 and an engaging lever 41, forms a 3-part lever system, that is supported at 42' and 42'' at the bottom 3 of the lock. A spring presses on the free end 39' of the toggle lever and, in so doing, pushes the the locking slide 35 to the left and also the botl 4 to the left, the lever system 39, 40, 41 acting as an intermediary.

The lever system 39, 40, 41 enables the locking slide 35 and the bolt 4 to work together. For this purpose, the latter is provided with a recess 44. A stop face 44' is provided on the left side and a stop face 44'' on the right side, and stops for the engaging lever 41 are formed. The upper toggle lever 39 forms an angle of about 90° and can shift the locking slide 35. The fishplate lever 40 is mounted on the opposite end of the toggle lever 39. With that, it is moved by the short end of the also knee-shaped engaging lever 41, when the latter rotates. Conversely, the free end of the engaging lever presses the bolt 4 inwards, when the former rotates in the opposite direction.

By appropriately changing the system of levers 39, 40, 41, it is possible to vary the extended length of the bolt.

The end of the spring-loaded catch 38 is provided with a fitted stay bolt 43; the locking slide 35 carries a further stay bolt 45. Said stay bolts 43 and 45 are touched at their outsides by recesses 46 and 47, which are produced on the inner side of the exchange lever 16 and which, upon a rotary or displacement movement of the exchange lever, shift the stay bolts 43 and 45 in a manner yet to be described.

A further complex of functions commences with a fish bar with elongated hole 50, which is mounted peripherally at the pusher nut 8 and which is fastened rotatably on the pusher nut 8 at 50'. The extended hole 51 of this fishplate 50 extends over more than one half of its length. A stay bolt 52 latches rotatably in the elongated hole 51. This stay bolt 52 in turn stands up on the lower lock bolt tumbler 53, which has approximately the shape of a rhombus. At its inner, vertical outside, the lock bolt tumbler 53 has a guide slot 54, which slides along a guide pin 55, which has a square cross section. Furthermore, a drop-in pin 56, on which the end of the spring 57 presses from above, is mounted on the lock bolt tumbler 53 in the upper area. In its lower part, the lock bolt tumbler 53 runs out into a tongue 58, which in turn strikes from the inside against the stop end 20' of the cam 20 and accordingly, as the cam is raised, also permits the lock bolt tumbler 53 to be raised.

The tumbler 6, which is provided with two notch recesses 60 and 61, lies on the bolt 4. The respective revolution positions are defined by latches of the drop-in pin. The tumbler 6 is disposed over the tail 4' of the bolt 4 and follows its contours. The tumbler 6 carries the bolt 24, which protrudes upwards and downwards. Upwards, it forms a guide element in the elongated hold guide 23; downwards, it protrudes into a further longitudinal hole guide 63. Moreover, a main pin 64 is provided, which guides the tumbler 6 as well as the tail 4' of the bolt 4 in appropriate recesses. The undersides of the two parts 6 and 4 are, moreover, provided with a revolution recess or a revolution stop 65, which is engaged by the closing beard 21 upon rotation.

DESCRIPTION OF THE FUNCTION

The lock, which is described in the following, shall carry out the following functions with mechanical means.

1. In the not closed state (bolt 4 inside), the lock catch 5 shall be pulled in by turning the pusher nut 8.

2. In the not closed state, with the pusher nut not turned, the catch and tail striking against the catch head 5', the bolt 4 shall jump out one rotation and close the door. 3. Simultaneously with the jumping out of the bolt 4, the catch shall be blocked against being pressed in further.

4. Independently of the position of the bolt 4, it shall be possible to unscrew this bolt 4 two or one further rotation with the help of the closing beard 21.

5. The unscrewed bolt shall be pulled in as the latch is pushed down ("panic function").

OPENING THE DOOR

FIGS. 1 to 4 in each case show two planes of the lock during the activation of the pusher and the therewith associated rotation of the pusher nut 8. At the same time, the arm 29 of the nose 30 of the pusher, after running over a clearance of a few millimeters, is pushed against the end 5''' of the catch 5. During this motion, the exchange lever 16 is turned clockwise via the pull bracket 26 around the joint 19, the recesses 46 and 47—with a certain, clearance-related delay—pushing the stay bolts 43 and 45 to the right. In so doing, the locking slide 35 pushes to the right and releases the safety catch. This movement precedes the movement of the catch 5, which takes place shortly after. The catch 5 thus becomes free and can move towards the right.

Moreover, after two closing turns, the bolt 4 is in its extreme left position. Before the rotary movement of the nut 8, the bolt 4 is prevented from retracting by the drop-in pin 56. By turning the nut 8, the fishplate with the elongated hole moves towards the top and, via the stay bolt 52, pulls the lock bolt tumbler 53 towards the top against the force of the spring 57. With that, the locking slide, pulled towards the right via the stay bolt 45, can turn the toggle lever 39 clockwise and hold the lever system 39, 40, 41 in such a fashion, that the engaging lever 41 presses with the long arm against the bolt 4. By so doing, the latter is shifted inwardly. By such a procedure, the socalled "panic opening" is accomplished.

FREEWHEEL WITH THE DOOR OPEN

If the bolt 4 is retracted, it should not be moved. The elements, moved during the movement of the pressure nut 8, do not exert any effect now on the bolt. However, as the lock beard 21 is turned, the cam 20 can be turned upwards and, with it, the exchange lever 16, so that the catch-side end 16' of the exchange lever 16 presses the catch inwards. This function is also known, as such, for locks of this type.

CLOSING THE DOOR

A different sequence of movments, however, takes place when the catch 5 is not retracted and, by pulling the door shut, the sloping part of the catch is forced inwards by a stop in the door frame. With that, the catch-side end 16' of the exchange lever 16 moves clockwise. Once again, the two stay bolts 43 and 45 are shifted. The spring-loaded catch 38 disengages and releases the locking slide 35, which moves in the direction of the cuff 2. This takes place because of the force of the spring 31. With that, the safety catch 33 is pressed upwards over the run-off piece 35' and, as the spring-loaded catch 5 falls back, rests in the recess 32. The catch can consequently no longer be forced back into the lock with a wire hook or a check card.

With this movement of the locking slide 35 to the left, the bolt 4 is also forced to the left. This takes place over the lever system 39, 40, 41. The bolt 4 is released, since the cam 20 and its stop end 20' raise the tongue 58 of the lock bolt tumbler 53 and, in so doing, disengage the drop-in pin 56. When the bolt 4 has made one revolution to the left, the lock bolt tumbler 53 subsides once again as the catch 5 springs out.

The bolt 4, screwed out by one revolution, can also be rotated through a second revolution, in that the closing beard 21 lays hold of the bolt end 4' and, with the lock bolt tumbler 53 raised, turns a further time. Conversely, it is also possible, by turning the closing beard 21 clockwise through two revolutions, to open the bolt and to draw the catch 5 via the cam 20 and the exchange lever 16 into the lock in the manner known for such mortise locks.

The result of this is that the lock, described above, carries out all the "normal" functions of a lock; in addition, however, it can carry out further functions, similar to those explained at the beginning of the description of the functions.

I claim:

1. A lock comprising a lock cylinder, a pusher nut, a catch and a safety bolt which can be actuated by the lock cylinder, the catch also being retractable by means of the pusher nut, and a catch locking slide, in a locked position of which the catch is blocked from being pushed in and in a release position of which, wherein the catch can be adjusted with the help of the pusher nut or the lock cylinder, the catch locking slide releases the catch, the locking slide being displaceable from a release position to a locked position by pressure on the catch, a lever system connecting the locking slide with the safety bolt and having a dogging portion which embraces the locking slide, the dogging portion being actuated into a dogging position solely by pushing in and moving out of the catch, without operating the lock cylinder or the pusher spindle.

2. The lock of claim 1, which includes a safety catch and in which the locking slide is mounted at a distance from the catch, and the safety catch is disposed between the locking slide and the catch, the safety catch engaging the catch in the locked position of the locking slide and disengaging the catch in the release position of the locking slide.

3. A lock in accordance with claim 1, in which the lever system connects the locking slide with the safety bolt in such a way that the safety bolt is pushed out of the lock when the locking slide is displaced from the release position thereof to the locked position thereof.

4. The lock of claim 1 which includes a spring and in which the spring acts upon the locking slide and the lever system, the spring pressing the locking slide into the locked position thereof.

5. The lock of claim 2, in which the locking slide includes a runoff piece, which shifts the safety catch.

6. The lock of claim 1, which includes a lever system connecting the catch with the lock cylinder and comprising an exchange lever and a cam.

7. The lock of claim 6, in which the exchange lever has recesses and which lock includes staybolts, which in turn are connected with the locking slide, and which includes a spring-loaded catch, which locks the locking slide, the recesses contacting the staybolts.

8. The lock of claim 7, which includes a lock bolt tumbler which carries a drop-in pin and in which the cam contacts the lock bolt tumbler.

9. The lock of claim 8, in which the safety bolt carries an additional tumbler.

10. The lock of claim 9, which includes a bracket connecting the lock bolt tumbler with the pusher nut and in which the lock bolt tumbler can be lifted out of its locked position by turning the pusher nut.

11. The lock of claim 10, in which the lever system comprises three levers, including two rigidly mounted levers which are toggle lever and fish plate lever, and a fish plate lever, the ends of the lever being supported in hinged fashion at ends of the levers opposite functional ends.

12. The lock of claim 11, in which the safety bolt can be extended to different lengths.

* * * * *